US007952038B1

(12) United States Patent
Ando et al.

(10) Patent No.: US 7,952,038 B1
(45) Date of Patent: May 31, 2011

(54) TWO-STAGE SWITCH APPARATUS

(75) Inventors: Hitoshi Ando, Saitama (JP); Brian St. Jacques, Newark, CA (US)

(73) Assignee: Shin-Etsu Polymer Co., Ltd., Saitama (JP)

( * ) Notice: Subject to any disclaimer, the term of this patent is extended or adjusted under 35 U.S.C. 154(b) by 3 days.

(21) Appl. No.: 12/631,081

(22) Filed: Dec. 4, 2009

(51) Int. Cl.
*H01H 13/48* (2006.01)

(52) U.S. Cl. ..... 200/1 B

(58) Field of Classification Search ..... 200/406, 200/516, 1 B, 517, 341, 520
See application file for complete search history.

(56) References Cited

U.S. PATENT DOCUMENTS 4,659,881 A * 4/1987 Dowe ..... 200/5 R
5,510,584 A * 4/1996 Norris ..... 200/5 A
7,166,813 B2 * 1/2007 Soma et al. ..... 200/600
7,217,893 B1 5/2007 Huang et al.
7,737,373 B2 * 6/2010 In et al. ..... 200/1 B
2009/0283390 A1 * 11/2009 Sharrah et al. ..... 200/1 B

* cited by examiner

*Primary Examiner* — Edwin A. Leon
(74) *Attorney, Agent, or Firm* — Posz Law Group, PLC

(57) ABSTRACT

A two-stage switch apparatus includes: a PCB including first and second electrodes; a conductive dome disposed on the PCB; an insulating film covering a surface of the conductive dome on a side opposite to the PCB, and third and fourth electrodes above the conductive dome; and a button actuator provided over a side of the insulating film, which is opposite the PCB. The button actuator includes a conductive elastic body protruding to the side of the insulating film at positions corresponding to both the third and fourth electrodes. An analog portion is formed by the conductive elastic body, the third electrode and the fourth electrode, when the conductive elastic body contacts both the third and fourth electrodes. A digital portion is formed by the conductive dome and the second electrode, when the button actuator is pressed and the conductive dome is indented.

16 Claims, 10 Drawing Sheets

TWO-STAGE SWITCH APPARATUS

TECHNICAL FIELD

The present invention relates to a switch apparatus, and in particular to a dual function switch apparatus having a two-stage switch structure.

RELATED ART

A single button actuator that can provide an additional input to an apparatus in addition to a typical on/off digital switch can provide the apparatus with various advantages. For example, if a key having a function of a two-stage switch is included in a panel of an audio apparatus, a number of switches do not need to be included. As a result, a design of a panel surface becomes simple, and a user can readily select a desired key.

Further, it is well known that a single two-stage switch having a focus function and a shutter function is provided in a number of cameras. In operating the two-stage switch, an operator can press the first-stage switch to execute focusing, and press the second-stage switch to turn on the shutter. An example of a structure of the two-stage switch is disclosed in U.S. Pat. No. 7,217,893.

The two-stage switch disclosed in U.S. Pat. No. 7,217,893 has a structure in which a silver paste PCB, a metal dome, a film with a couple of through holes, a flexible contact body having a downwardly extending conductive block passing through the through holes, and a button body having a contact pin pressing the center of an external surface of the metal dome are sequentially disposed from the bottom. When the button body is pressed, first, the conductive block contacts the metal dome. When the button is continuously pressed, the metal dome is pressed and two electrodes on the PCB are electrically connected to each other.

The two-stage switch having the above structure may generate an erroneous operation due to deterioration of elasticity of the flexible contact body over time. Further, since the two-stage switch has a structure in which the first-stage switch and the second-stage switch are turned on at respective positions separated from each other, the entire area of the switch becomes larger. For this reason, a simpler and smaller structure is demanded. Further, the two-stage switch, which is a switch that generates an on/off digital signal, is limited in application.

SUMMARY

In view of the above, a two-stage switch apparatus having a simple structure that is capable of generating an analog signal and a digital signal is provided. The two-stage switch apparatus includes a two-stage switch that has a structure in which a printed circuit board (PCB), a conductive dome (for example, a metal dome), an insulating film, and a button actuator are sequentially disposed.

On a surface of the PCB, first and second electrodes for contacts are formed to be separated from each other. The conductive dome is disposed on the PCB, in a state where the conductive dome is electrically connected to the first electrode and unconnected to the second electrode. For example, the first electrode may be formed on the PCB to contact an edge of the conductive dome, and the second electrode may be formed on the PCB that corresponds to substantially the center of the conductive dome. The insulating film is a thin insulting layer that covers a surface of the conductive dome on the side opposite to the PCB. On the insulating film, third and fourth electrodes for contacts are formed on an outer surface thereof above the conductive dome in a state where the third and fourth electrodes are separated from each other. From this view point, the insulating film may be referred to as a film PCB.

The button actuator is provided over the side of the insulating film, which is opposite to the PCB, and is capable of being pressed in a direction toward the insulating film. The button actuator includes a conductive elastic body protruding to the side of the insulating film on the surface thereof on the insulating film side and at positions corresponding to both the third and fourth electrodes. The conductive elastic body and the third and fourth electrodes form one analog portion. As a result, when the button actuator is pressed toward the PCB, an area where the conductive elastic body contacts both the third and fourth electrodes increases according to a pressing distance of the button actuator, and electrical resistance between the third electrode and the fourth electrode decreases with the increase in the area.

Further, the conductive dome and the second electrode form one digital portion. As a result, if the button actuator is pressed toward the PCB and the conductive dome is indented, or in other words fully depressed, or deformed, the conductive dome can be electrically connected to the second electrode.

In one aspect, a space may exist between the insulating film and the conductive elastic body, in a default state where the button actuator is not pressed. This space can open the analog portion, in the default state where the button actuator is not pressed. As a result, power consumption can be saved.

In another aspect, the conductive elastic body may have a shape in which an area of a horizontal section decreases toward the insulating film. For example, the shape of the conductive elastic body may be a hemispheric shape where a surface on the side of the insulating film is configured as a spherical surface, or a conical shape where the surface is configured as a spire. However, since the conductive dome has a spherical shape that protrudes toward the button actuator, the analog portion may be formed even when the shape of the conductive elastic body is a flat plate shape.

In yet another aspect, the two-stage switch apparatus further may include a detecting device that detects a change in electrical resistance from each of the analog portion and the digital portion. The detecting device can determine whether the change in the electrical resistance from the analog portion or a change in voltage resulting from the change in the electrical resistance exceeds a predetermined threshold value, and can determine that the analog portion is input (or activated), when the change exceeds the predetermined threshold value. The threshold value may be recorded in a memory, such as a RAM or a ROM, and the detecting device can read out the threshold value from the memory, and determine an input (or activation) of the analog portion.

In still another aspect, the detecting device may determine an input of the analog portion before detecting an input of a switch in the digital portion. For example, if the conductive elastic body having a low elasticity coefficient or the conductive dome having high rigidity is used and the button actuator is pressed toward the PCB, first, the analog portion is input. Next, the conductive dome is indented or fully depressed or deformed and the digital portion is input. However, if the conductive elastic body having a high elasticity coefficient or the conductive dome having low rigidity is used and the button actuator is pressed toward the PCB, first, the conductive dome is indented and the digital portion is input. Next, the conductive elastic body is pressed and the analog portion is input.

Further, in another aspect of the present invention, the PCB may include a combined circuit where an analog circuit including the analog portion and a digital circuit including the digital portion are electrically combined. The detecting device may detect an input of the analog portion and an input of the digital portion based on a single output voltage from the combined circuit. Note that the analog portion means that it produces an analog signal based on a change in electrical resistance or in voltage in that portion, and the digital portion means that it produces an on or off signal (digital signal) based on a change in electrical resistance or in voltage in that portion.

DETAILED DESCRIPTION

Hereinafter, preferred but non-limiting embodiments of the present invention will be described with reference to the accompanying drawings.

Figure 1:
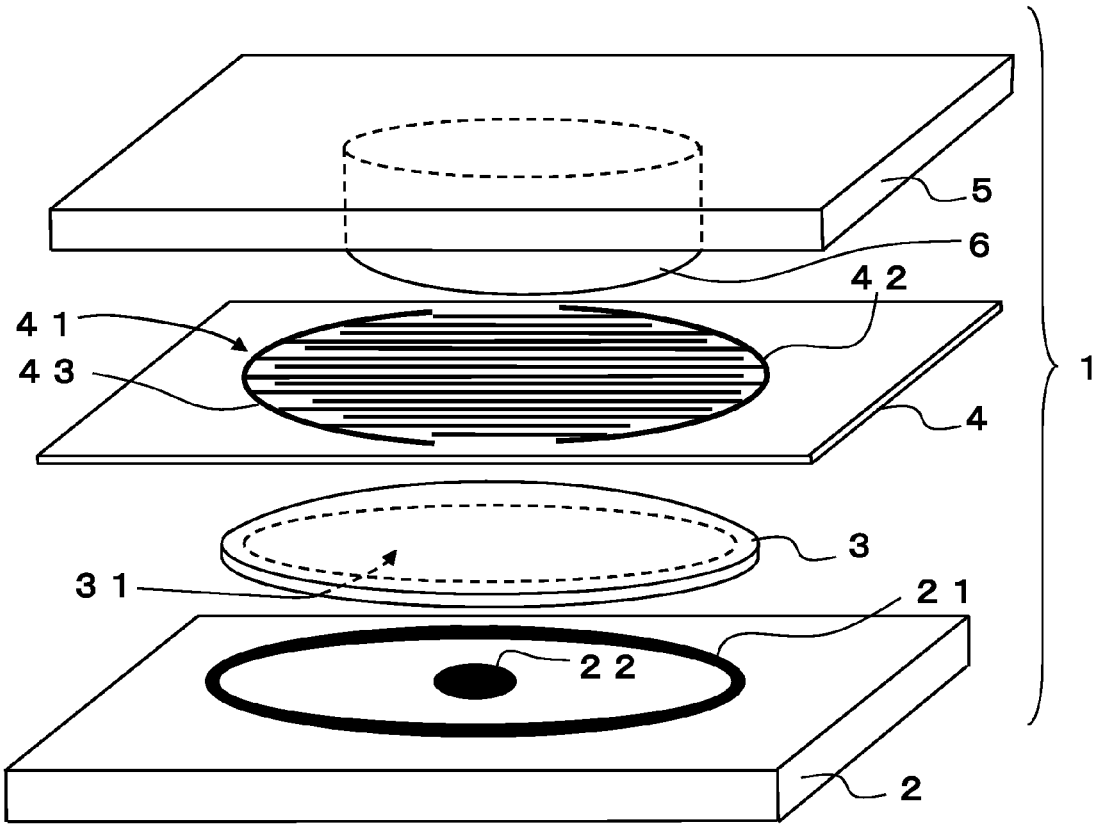
FIG. 1 is an exploded perspective view of an exemplary two-stage switch apparatus according to one embodiment.
Figure 2:
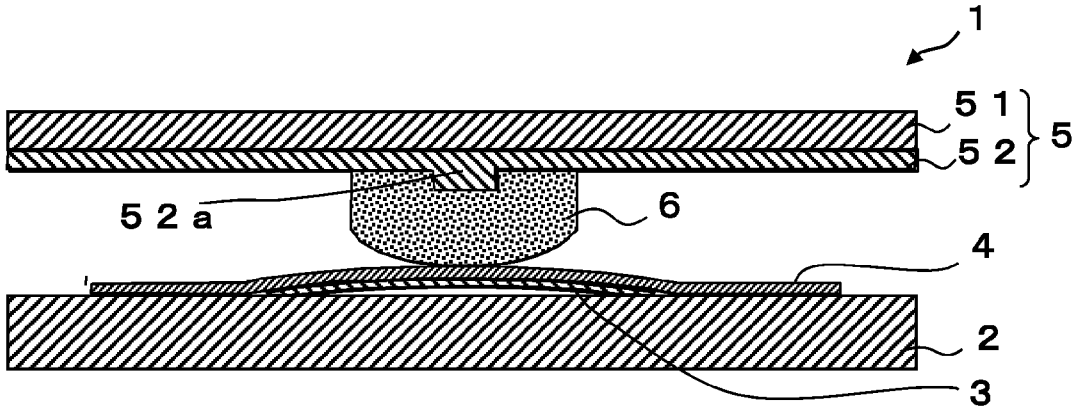
FIG. 2 is a side, cross-sectional view of the exemplary two-stage switch apparatus of FIG. 1.

As shown in FIGS. 1 and 2, in one embodiment, a two-stage switch apparatus 1 includes a printed circuit board (hereinafter, simply referred to as PCB) 2, a conductive dome (preferably, metal dome) 3, an insulating film 4, and a button actuator 5. The conductive dome 3 is disposed on the PCB 2 and the insulating film 4 is disposed on the conductive dome 3. The button actuator 5 is provided over the conductive dome 3 such that a portion thereof may be in contact with the insulating film 4.

On a surface of the PCB 2, one or more circuits are formed by a conductive trace (preferably, copper, silver, gold or tungsten trace). In a portion of the circuit, first and second electrodes 21 and 22 for contacts are formed separately from each other, as shown in FIG. 1. In this embodiment, the first electrode 21 is formed in a substantially circular shape, and the second electrode 22 is formed in a shape of a dot and is disposed at substantially the center of the first electrode 21; however, the shapes and arrangement positions of the first and second electrodes 21 and 22 are not limited thereto.

The substantially circular conductive dome 3 has a slightly protruding central portion. The conductive dome 3 is formed of a material that has superior conductivity and is easily elastically deformed such as, for example, stainless steel or a material where silver is coated on a surface of stainless steel. The conductive dome 3 is disposed on the PCB 2 in a state where a rear side 31 of the protruding portion faces the PCB 2, such that the conductive dome 3 may be electrically connected to the first electrode 21 and unconnected to the second electrode 22. As a result, when pressure is not applied on the protruding central portion of the conductive dome 3 toward the side of the PCB 2, the first electrode 21 and the second electrode 22 are not electrically connected to each other.

The insulating film 4 is formed of a thin resin or an elastic material that is superior in its insulating property and its flexibility. Similarly to the PCB 2, the insulating film 4 has an electronic circuit that is composed of a conductive trace on its surface. In the electronic circuit, third and fourth electrodes 42 and 43 for contacts are formed separately from each other. The third and fourth electrodes 42 and 43 are interdigital electrodes that have substantially the same shape, and can be disposed in a state where the teeth of one of the third and fourth electrodes are inserted into gaps between the teeth of the other but do not contact each other. The third electrode 42 and the fourth electrode 43 constitute a contact electrode 41. The contact electrode 41 can be formed on the insulating film 4 with a size that is equal to or smaller than an area of the conductive dome 3. However, the contact electrode 41 may be larger than the conductive dome 3. The shapes of the third electrode 42 and the fourth electrode 43 are not limited to shapes having several teeth but may be other shapes such as, for example, semicircular shapes. The insulating film 4 is disposed on the conductive dome 3 in a state in which a surface where the contact electrode 41 is formed is opposite to the conductive dome 3. The electronic circuit on the insulating film 4 can be coupled to the electronic circuit on the PCB 2, thereby configuring one or more electronic circuits.

As shown in FIG. 2, the button actuator 5 has flat members 51 and 52 bonded to each other. The flat members 51 and 52 can be composed of any material such as resin, an elastic body, metal, glass, and ceramics. The flat members 51 and 52 may be integrated by interposing an adhesive or a two-sided tape between bonding surfaces thereof, or engaging concave-convex portions formed on the bonding surfaces thereof. Further, the button actuator 5 may be an integrated body. The flat member 52 includes a convex portion 52*a*. On the convex portion 52*a*, a conductive elastic body 6 is fixed.

The conductive elastic body 6 is composed of a material having high elasticity such as synthetic rubber, thermoplastic elastomer or natural rubber. Since a conductive material is kneaded in the conductive elastic body 6, the conductive elastic body 6 is an elastic body that is also highly conductive. Preferred examples of the conductive material include carbon and metal. The conductive material can be formed in various shapes, such as particles, platelets, whiskers, strands, and fibers. The conductive elastic body 6 is formed in a substantially columnar shape. One face of the conductive elastic body 6 has a curved surface shape and the other face has a substantially planar shape. The conductive elastic body 6 also has a non-through hole (a depression) at the center thereof. The resistance per square of the conductive elastic body 6 falls within the range of about 10 to 100 ohms per square inch. In some applications, when the conductive elastic body 6 is pressed with a load of 1 kgf, the conductive elastic body 6 has a resistance between about 100 and 10,000 ohms, more preferably, between about 170 and 1,700 ohms.

The face of the conductive elastic body 6 that includes the curved surface may have, instead of the curved surface, a surface with a horizontal sectional area that decreases toward a front end (for example, a conical shape, a pyramidal shape, and a shape where a tip of a circular cone or a pyramid is configured as a planar surface). The conductive elastic body 6 can be fixed on the button actuator 5 by fitting the convex portion 52*a* of the button actuator 5 into the depression. The button actuator 5 where the conductive elastic body 6 is fixed is disposed above the PCB 2, in a state where the curved surface portion of the conductive elastic body 6 contacts the substantially central portion of the contact electrode 41. Note that the combined structure or function of the button actuator 5 and the conductive elastic body 6 is referred to as an elastically deformable conductive actuator.

Figure 3:
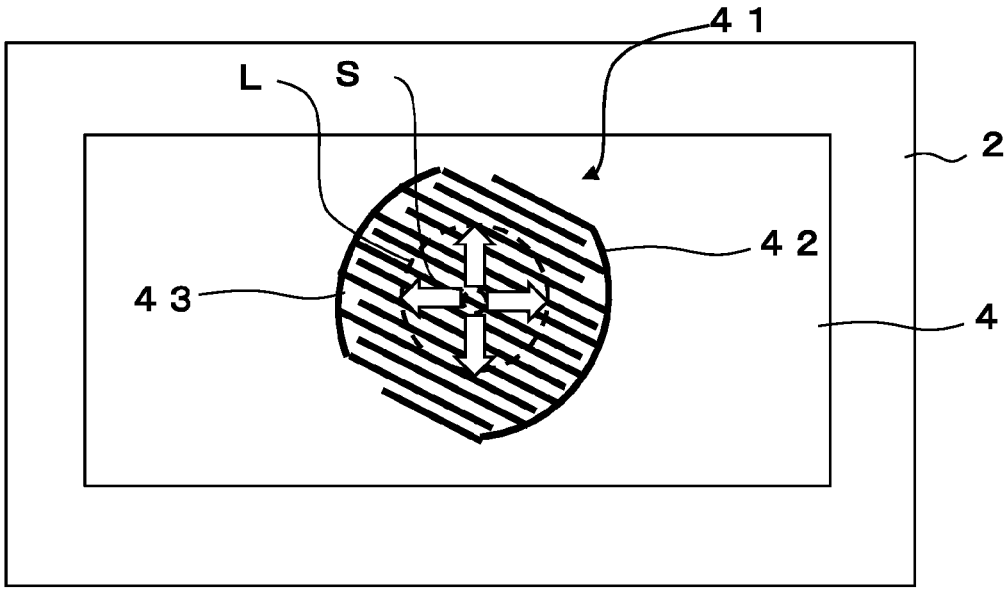
FIG. 3 is a top view of a PCB with a film of the exemplary two-stage switch apparatus of FIG. 1.

As shown in FIG. 3, when an area where the conductive elastic body 6 contacts the substantially central portion of the contact electrode 41 increases from S as an initial value to L, electrical resistance between the third electrode 42 and the fourth electrode 43 decreases depending on the increase in the area. In other words, the electrical resistance between the third electrode 42 and the fourth electrode 43 varies inversely to respective surface areas of the third electrode 42 and the fourth electrode 43 contacted by the button actuator 5. In this view point, the conductive elastic body 6 functions as a variable resistor, and an analog portion 6*a* (see FIG. 4) is formed by the third electrode 42, the fourth electrode 43, and the conductive elastic body 6.

Figure 4:
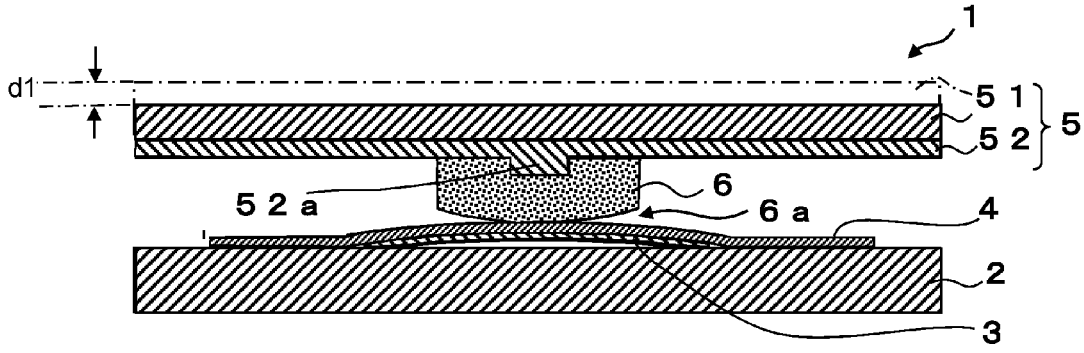
FIG. 4 is a side, cross-sectional view of the exemplary two-stage switch apparatus when the two-stage switch of FIG. 1 is pressed to a first stage.
Figure 5:
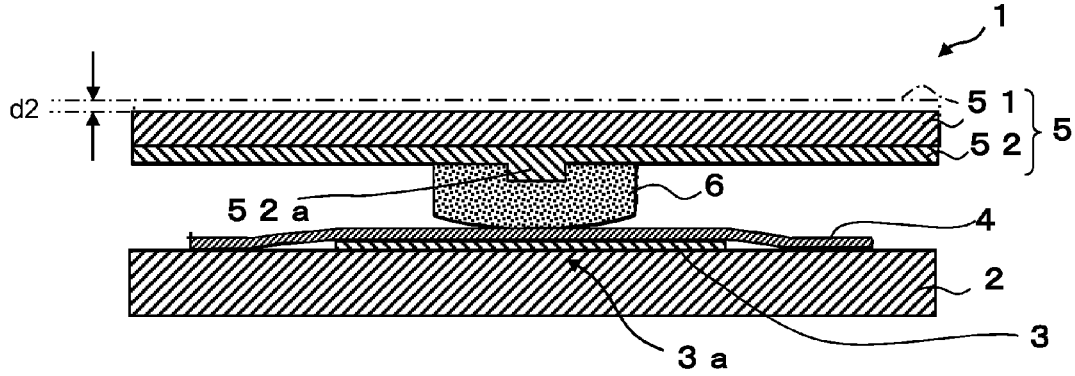
FIG. 5 is a side, cross-sectional view of the exemplary two-stage switch apparatus of FIG. 1 when the two-stage switch is pressed to a second stage.

A state shown in FIG. 4 is a first stage. In the first stage, the conductive dome 3 is not indented by a pressing force. Accordingly, the first electrode 21 and the second electrode 22 on the PCB 2 are not electrically connected to each other. In FIG. 4, a physical gap "d1" is a distance between a state of not pressing the button actuator 5 and a state of pressing the button actuator 5 in the first stage. As shown in FIG. 5, if the button actuator 5 is further depressed from this state, and as a result, the conductive dome 3 is indented or fully deformed. As a result, the first electrode 21 and the second electrode 22 on the PCB 2 are electrically connected to each other.

A state shown in FIG. 5 is a second stage. In this view point, the conductive dome 3 functions as a digital switch, and a digital portion 3*a* is formed by the first electrode 21, the second electrode 22 and the conductive dome 3. In FIG. 5, a physical gap "d2" is a distance between a state of pressing the button actuator 5 in the first stage and a state of pressing the button actuator 5 in the second stage.

Figure 6A:
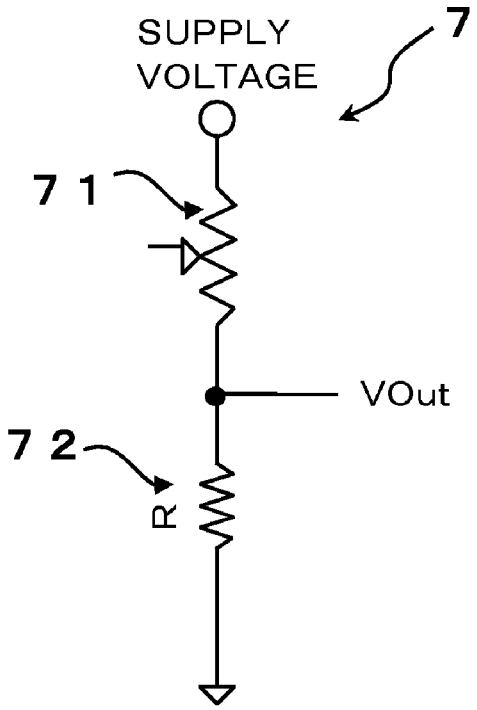
FIGS. 6A and 6B are electrical diagrams showing each exemplary circuit having an analog portion and a digital portion separately.
Figure 6B:
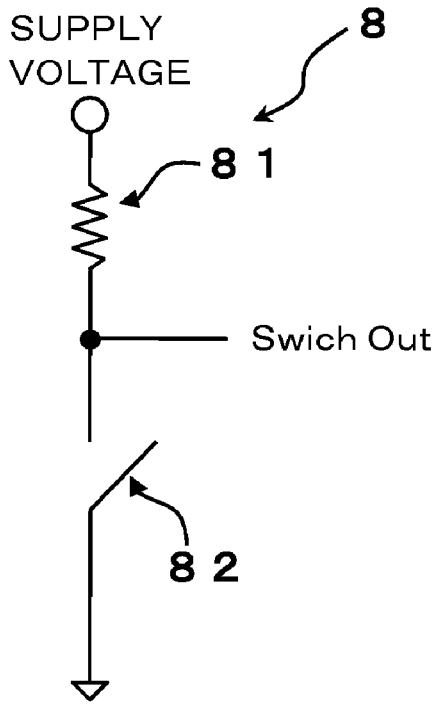

FIGS. 6A and 6B are electrical diagrams exemplifying a portion of a two-stage switch detecting circuit that is included in the two-stage switch apparatus 1, and show an example where a first-stage switch detecting circuit (FIG. 6A) and a second-stage switch detecting circuit (FIG. 6B) are separately configured. As shown in FIG. 6A, the first-stage switch detecting circuit is a so-called analog circuit 7 in which resistance between the third electrode 42 and the fourth electrode 43 gradually decreases as a contact area of the conductive elastic body 6 and the contact electrode 41 increases. On the other hand, as shown in FIG. 6B, the second-stage switch detecting circuit is a so-called digital circuit 8 in which resistance between the first electrode 21 and the second electrode 22 rapidly decreases when the conductive dome 3 contacts the first electrode 21 and the second electrode 22. The analog circuit 7 includes a variable resistor 71 that is formed by a contact portion (analog portion) 6*a* of the conductive elastic body 6 with respect to the contact electrode 41, and a reference resistor 72. By including the reference resistor 72 in the analog circuit 7, it is possible to calculate a value of the variable resistor 71 from a measurement of an output voltage (VOut). In a case where an input of the first-stage switch is detected by touching (contacting) the button actuator 5, it can be configured such that the input of the first-stage switch is detected when a ratio (or difference) of the output voltages before and after the touch (contact) exceeds a predetermined threshold value.

On the other hand, the digital circuit 8 includes a resistor 81, the conductive dome 3, and a digital switch 82 that is configured by the first electrode 21 and the second electrode 22. The input of the switch can be detected only when the conductive dome 3 is electrically connected to the first electrode 21 and the second electrode 22.

Figure 7:
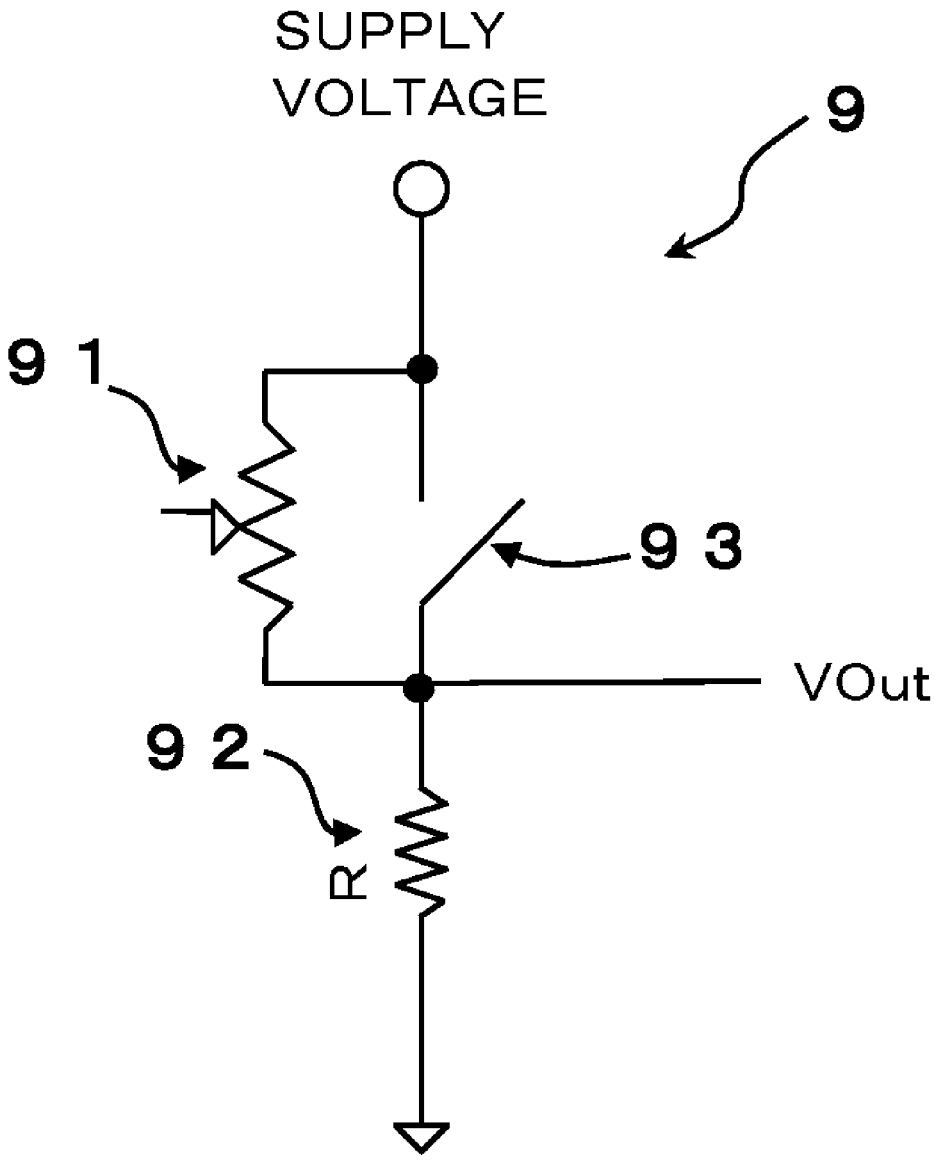
FIG. 7 is an electrical diagram showing an exemplary single circuit having an analog portion and a digital portion in parallel.

FIG. 7 is an electrical diagram exemplifying a portion of a two-stage switch detecting circuit that is included in the two-stage switch apparatus 1, which shows an example where a first-stage switch detecting circuit and a second-stage switch detecting circuit are combined. As shown in FIG. 7, a combined circuit 9 is a circuit where the first-stage switch detecting circuit and the second-stage switch detecting circuit are combined. In the combined circuit 9, a variable resistor 91 that is formed by the analog portion 6*a* and an on/off switch 93 that is formed by the digital portion 3*a* are disposed in parallel, and a reference resistor 92 is connected in series with the variable resistor 91 and the on/off switch 93. As compared with the separate circuits shown in FIG. 6, the combined circuit 9 has an advantage in that detection of the two-stage switch is enabled with a simple configuration. An input of each switch can be determined by measuring a single output voltage (VOut). Also in the combined circuit 9, by including the reference resistor 92, detection of the first-stage switch can be accurately calculated, for the same reason as in the above case. Further, when the switch 93 is turned on, the output voltage (VOut) is rapidly lowered. As a result, an input of the second-stage switch can be detected.

Figure 8:
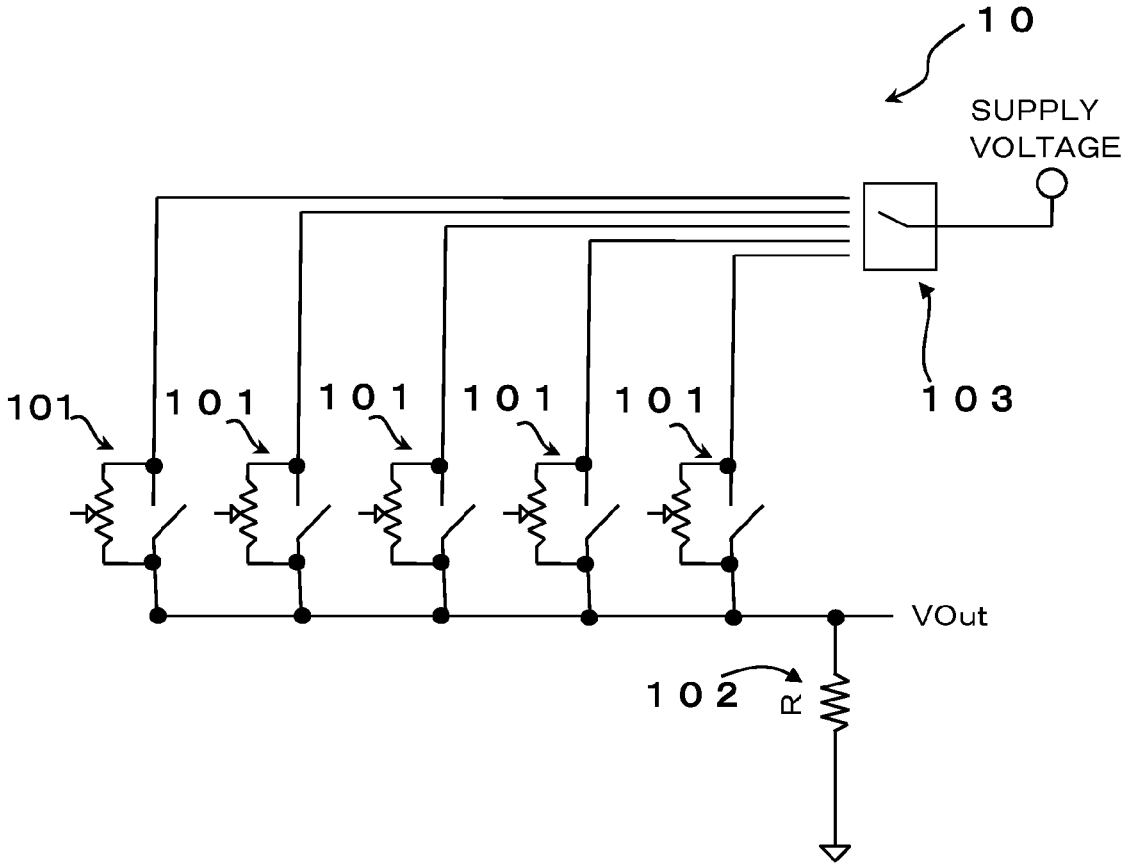
FIG. 8 is an electrical diagram showing an exemplary single circuit having multiple parallel portions including an analog portion and a digital portion.

FIG. 8 is a diagram illustrating an example of a multiple circuit 10 that includes a plurality of combined circuits. When there is a plurality of two-stage switch apparatuses 1, the multiple circuit 10 shown in FIG. 8 may be formed. The multiple circuit 10 includes a switching portion 103 that supplies a voltage to each parallel circuit 101, and includes a reference resistor 102 as a common resistor to the parallel circuits 101. The multiple circuit 10 detects one output voltage (VOut) at an intersection of the reference resistor 102 and the parallel circuit 101. The output voltage is detected in synchronization with the switching portion 103, and the parallel circuit 101 where a voltage is supplied can be recognized. If such a multiple circuit 10 is configured, resources and space can be saved and inputs of the plurality of two-stage switch apparatuses 1 at each stage can be detected even in the case where there is a plurality of two-stage switches.

Figure 9:
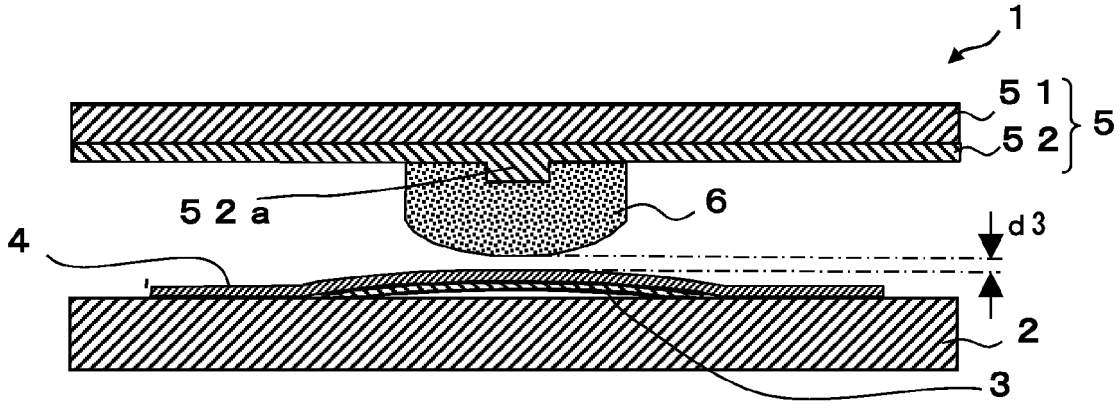
FIG. 9 is a side, cross-sectional view of another exemplary two-stage switch apparatus in which a conductive elastic body is separated from a film when no press is added according to one embodiment.

FIG. 9 is a cross-sectional view of another two-stage switch apparatus 1 where the conductive elastic body 6 does not contact the contact electrode 41 on the insulating film 4 and a physical gap d3 exists between the conductive elastic body 6 and the contact electrode 41, in a default state where the button actuator 5 is not pressed.

Figure 10:
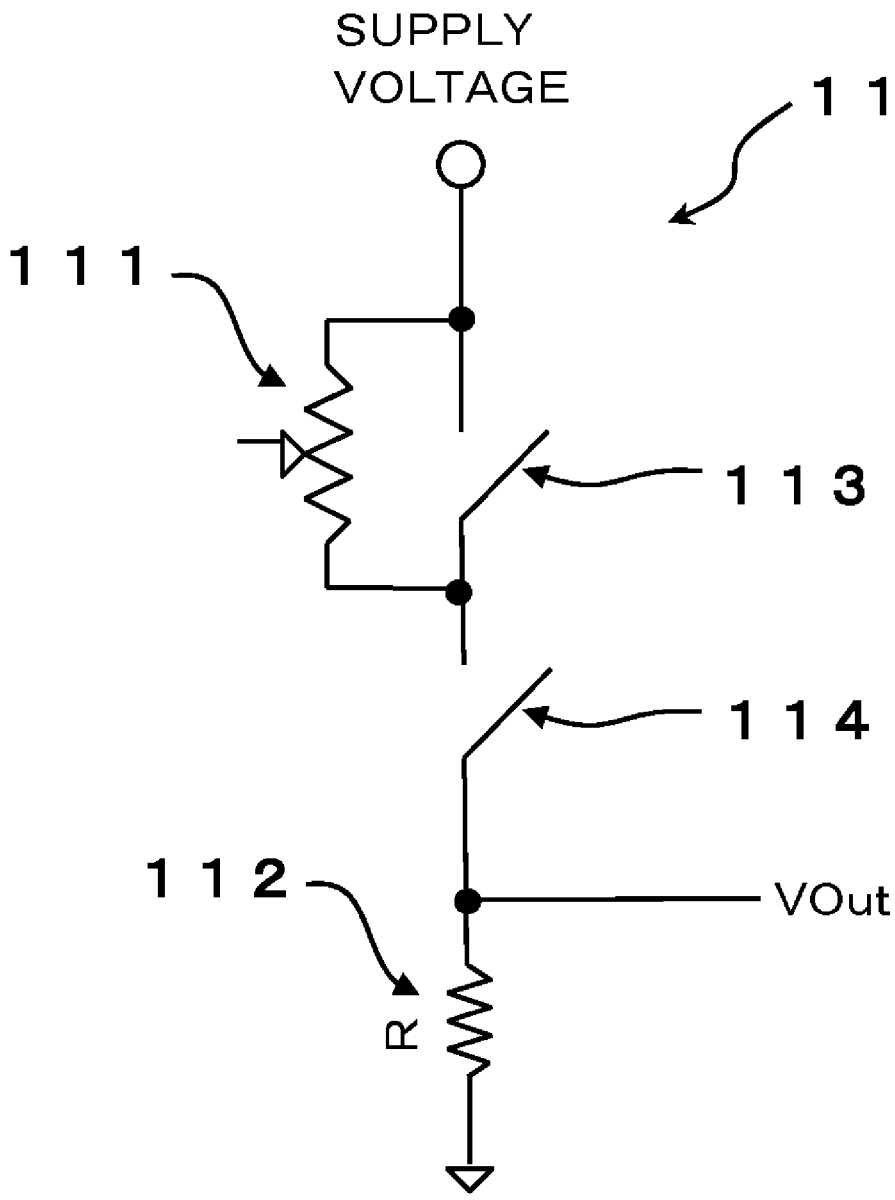
FIG. 10 is an electrical diagram showing an exemplary single circuit having an analog portion and a digital portion in parallel, which is on a PCB of the two-stage switch apparatus illustrated on FIG. 9.

FIG. 10 is an electrical diagram exemplifying a portion of a two-stage switch detecting circuit that is included in the two-stage switch apparatus 1 shown in FIG. 9, which shows an example where the first-stage switch detecting circuit and the second-stage switch detecting circuit are combined. A combined circuit 11 shown in FIG. 10 is a circuit where an on/off switch 114 is added to the configuration of the combined circuit 9 shown in FIG. 7. The switch 114 is provided between a parallel circuit composed of a variable resistor 111 and a switch 113 and a reference resistor 112. An output voltage (VOut) is measured between the switch 114 and the reference resistor 112.

A state where the conductive elastic body 6 does not contact the contact electrode 41 is one where the switch 114 is open. A situation where the conductive elastic body 6 contacts the contact electrode 41 and electrical resistance between the third electrode 42 and the fourth electrode 43 decreases is one where the switch 114 is closed. If the conductive elastic body 6 and the contact electrode 41 are kept in a non-contact state, power consumption can be reduced.

Figure 11:
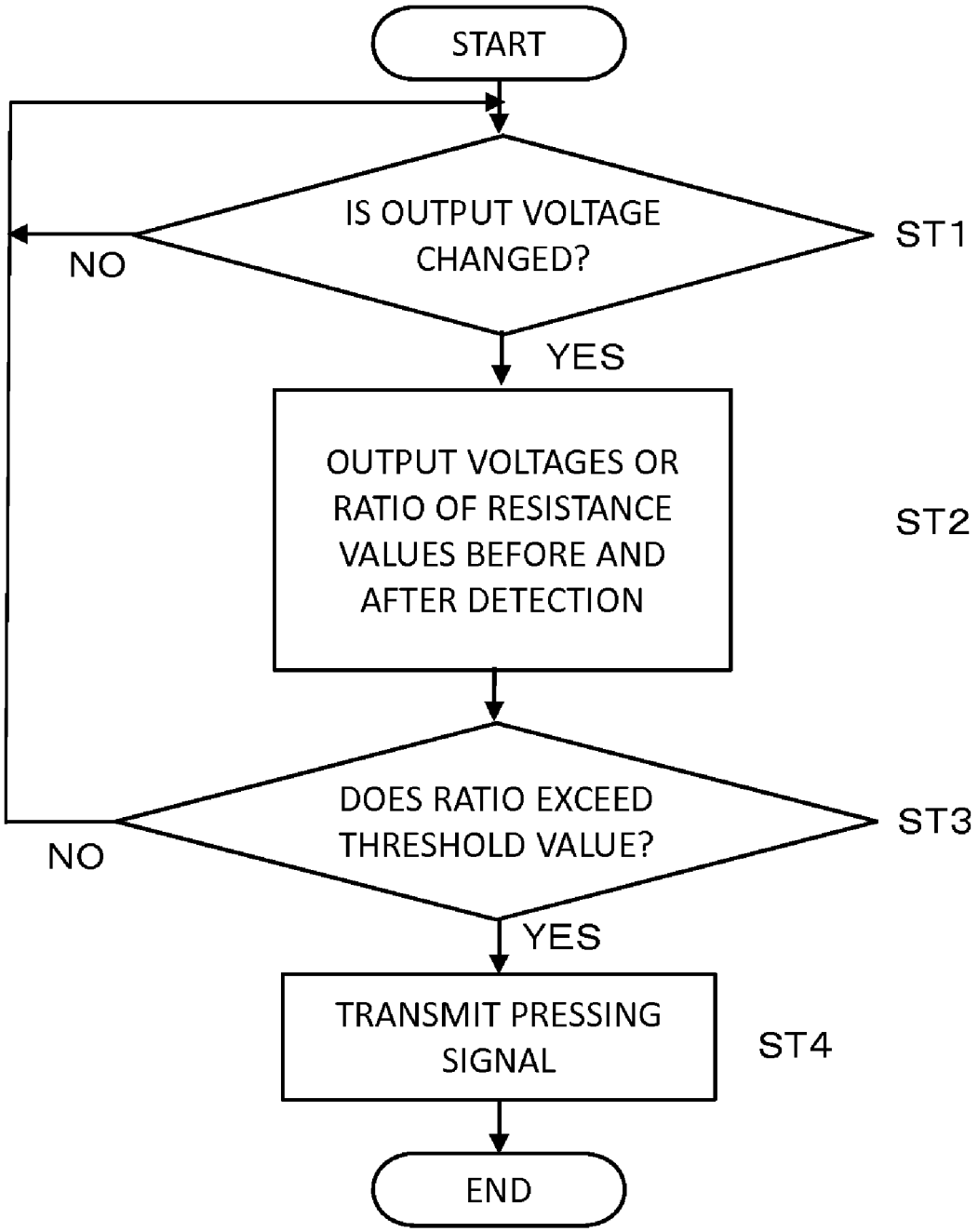
FIG. 11 is a flow diagram showing a process of switch detection by an exemplary two-stage switch apparatus according to the present invention.
Figure 12:
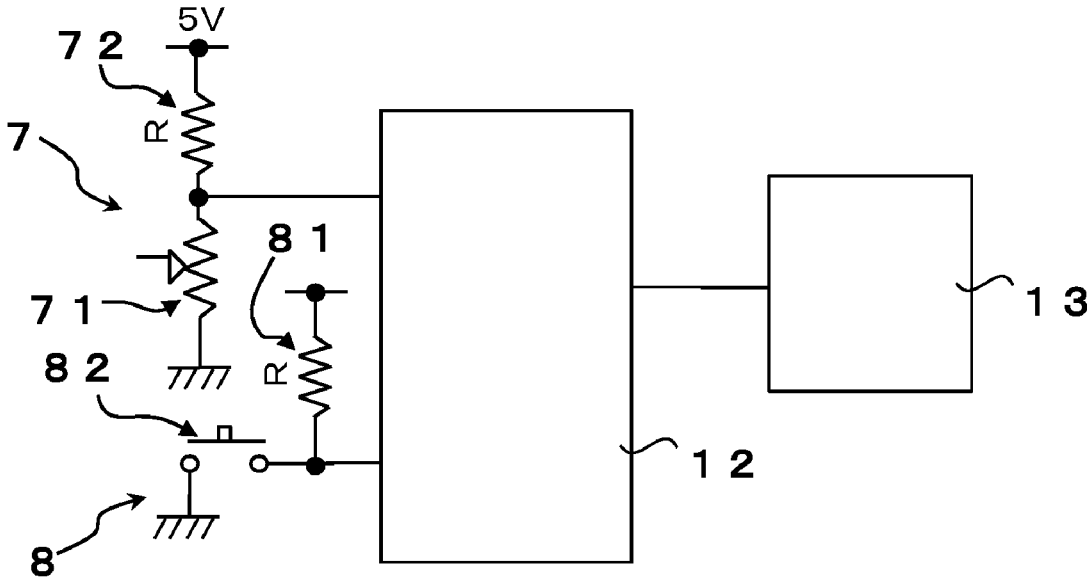
FIG. 12 is an exemplary structure of an electrical circuit including a microprocessor, a memory, an analog portion and a digital portion to execute the flow diagram shown on FIG. 11.

FIG. 11 is a flow diagram illustrating a flow of processes to detect an input of the first-stage switch. FIG. 12 is a diagram illustrating a hardware configuration that executes the processes shown in FIG. 11.

On the PCB 2, a microprocessor 12 and a memory (Random Access Memory: RAM, Read Only Memory: ROM) 13 that are electrically connected to the analog circuit 7 and the digital circuit 8 described with reference to FIG. 6 are disposed. However, the combined circuit 9 and the multiple circuit 10 that are described with reference to FIGS. 7 and 8 may be connected to the microprocessor 12 and the memory 13. The microprocessor 12 has a function of executing various operation processes.

The memory 13 stores various computer programs including ones to execute the processes shown in FIG. 11. The microprocessor 12 is a detecting device that detects a pressing force from the button actuator 5 toward the PCB 2. The microprocessor 12 can detect an input of the switch based on an electrical signal from the analog circuit 7, while reading out the computer programs stored in the memory 13. The microprocessor 12 determines whether a change in electrical resistance of the analog circuit 7 exceeds a predetermined threshold value. When it is determined that the change exceeds the predetermined threshold value, the microprocessor 12 detects the pressing force. When it is determined that the change does not exceed the predetermined threshold value, the microprocessor 12 does not detect the pressing force. Specifically, the following processes are executed.

First, the microprocessor 12 monitors an output voltage from the analog circuit 7, and determines whether there is a change in the output voltage (ST1). When it is determined that there is a change in the output voltage, the microprocessor 12 calculates a ratio of the output voltages before and after touching the button actuator 5 or a ratio of variable resistance values based on the ratio of the output voltages (ST2). Next, the microprocessor 12 determines whether the ratio exceeds a threshold value stored in the memory 13 (ST3). When it is determined in ST3 that the ratio exceeds the threshold value, the microprocessor 12 determines that the first switch is pressed, and outputs a pressing signal (ST4). On the other hand, when it is determined in ST3 that the ratio does not exceed the threshold value, the microprocessor 12 determines that the first-stage switch is not pressed, and the procedure is returned to ST1 without proceeding to ST4.

The microprocessor 12 may be called a central processing unit (CPU). Further, a difference between the output voltages or a difference between the variable resistance values obtained based on the difference between the output voltages may be used instead of the ratio of the output voltages or the ratio of the variable resistance values obtained based on the ratio of the output voltages in ST2.

As described above, by performing a process to determine whether an input of the switch in the analog circuit 7 exists based on relative values before and after the electrode touches (contacts) the button actuator 5, an erroneous operation of the input detection can be effectively prevented. If dimension tolerance of the button actuator 5 is set such that clearance between the button actuator 5 and a housing (not shown) where the two-stage switch apparatus 1 is incorporated is zero or very small, generally, the conductive elastic body 6 may be slightly pressing the contact electrode 41 in a state where the button actuator 5 is not pressed. In this case, for example, if it is attempted to detect an input of the switch based on an absolute value of the output voltage or the variable resistance, a minimum resistance value when the button actuator 5 is not pressed should be used as the threshold value. This is because otherwise it may be determined that the switch is input, even when the button actuator 5 is not pressed.

However, if it is determined whether the switch is input based on the relative values before and after the touch (contact), a resistance value when the button actuator 5 is pressed will be always smaller than a resistance value in a state where the button actuator 5 is not pressed, whatever value of the latter is. Therefore, erroneous operation can be reduced.

Since the analog signal is proportional to the force applied to the button actuator 5, signal levels corresponding to desired forces may be applied as a threshold to trigger an event before and/or after the digital portion 3*a* of the button actuator 5 has been fully actuated. This would be similar in function to a button input; however, the signal threshold may be selected to accept or prevent actions at specific ranges in the force actuation range of the button actuator 5. The analog signal thresholds may also be dynamically adjustable during operation to suit different conditions.

The above-referenced two-stage switch apparatus may be applicable to following exemplary embodiments.

Example 1

Application to Control Camera Auto-Focus and Picture Capture

A signal threshold is selected that corresponds to a force less than that required to actuate the digital portion 3*a*. When this analog signal threshold is exceeded, the auto-focus mechanism in the camera is triggered to remain active. As force on the button actuator 5 is increased and the digital portion 3*a* of the button actuator 5 is actuated, then the camera picture capture is activated in response to this event.

Example 2

Application to Ready a System for Further Input

A signal threshold is selected that corresponds to a force less than that required to actuate the digital portion 3*a*. When this analog signal threshold is exceeded, the system performs some action in preparation for receiving input from the digital portion 3*a* of the button actuator 5. System actions in response to the analog signal trigger could include resuming from a sleep or idle state, changing mode to accept button input, or providing feedback to the user that the corresponding actuation force on the button actuator 5 has been recognized.

Example 3

Application to Detect an Excessive Force Applied to a Button Actuator

A signal threshold is selected that corresponds to a force greater than that required to actuate the digital portion 3*a*. When this analog signal threshold is exceeded, the system takes action to trigger an event and/or provide feedback to the user that the corresponding actuation force on the button actuator 5 has been exceeded. In addition to providing specific force threshold detection, the analog signal may be used to control some function by providing an output proportional to the force applied to the button actuator 5 before, during, or after the digital portion 3*a* has been actuated. This output can be used to vary the response of an element within the system in proportion to the applied force on the button actuator 5.

Example 4

Application to Control a Power Window

The analog output signal range generated before the digital portion 3*a* is actuated is mapped to a speed control output to an electric motor, with low force corresponding to low speed and increasing forces corresponding to increasing speeds. The user controls the speed of the moving window by adjusting the applied force on the button actuator 5 to the desired level. Actuating the digital portion 3*a* would result in the window moving to the end of travel without any further input required from the user. A pair of two-stage switch apparatuses 1 could be used to separately control up and down movement, or a toggle function could be used to enable a single two-stage switch apparatus 1 to work in a reverse direction.

Example 5

Application to Navigate a List or Sequence within a System

The analog output signal range generated before the digital portion 3*a* is actuated is mapped to a speed control output to progress to the next element within a list or sequence, with low force corresponding to low speed and increasing forces corresponding to increasing speeds. The user controls the speed of selection change by adjusting the applied force on the button actuator 5 to the desired level. Actuating the digital portion 3*a* would result in the selection advancing to the last element within the list or sequence. Additionally, time thresholds may be applied to the analog and digital actuations to change the system's response to the events. For example, if the digital portion 3*a* is actuated within a short period of detected analog input, the system could discard any analog input and advance a single element instead of advancing the selection to the last element. A pair of two-stage switch apparatuses 1 could be used to separately control forward and backward selection change, or a toggle function could be used to enable a single two-stage switch apparatus 1 to work in a reverse direction.

What is claimed is:

1. A two-stage switch apparatus comprising:

a printed circuit board (PCB) including first and second electrodes for contacts that are formed separately from each other on a surface thereof;

a conductive dome disposed on the PCB, in a state where the conductive dome is electrically connected to the first electrode and unconnected to the second electrode;

an insulating film covering a surface of the conductive dome on a side opposite to the PCB, and including third and fourth electrodes for contacts that are formed separately from each other on a portion of an outer surface thereof above the conductive dome; and a button actuator provided over the insulating film on a side opposite to the PCB and capable of being pressed in a direction toward the insulating film, wherein the button actuator includes a conductive elastic body protruding toward the insulating film and at positions corresponding to both the third and fourth electrodes, the conductive elastic body, the third electrode and the fourth electrode form an analog portion such that an area where the conductive elastic body contacts both the third and fourth electrodes increases according to a pressing distance of the button actuator, and that electrical resistance between the third electrode and the fourth electrode decreases with the increase in the area, and the conductive dome and the second electrode form a digital portion such that the conductive dome is electrically connected to the second electrode, when the button actuator is pressed and the conductive dome is indented.

2. The two-stage switch apparatus according to claim 1, wherein the conductive elastic body is not in contact with the insulating film in a default state.

3. The two-stage switch apparatus according to claim 1, wherein the conductive elastic body has a horizontal section with an area that decreases in a direction toward the insulating film.

4. The two-stage switch apparatus according to claim 1, further comprising:

a detecting device that detects a change in electrical resistance from each of the analog portion and the digital portion, wherein the detecting device determines whether the change in electrical resistance from the analog portion or a change in voltage resulting from the change in the electrical resistance exceeds a predetermined threshold value, and determines that the analog portion is activated when the change exceeds the predetermined threshold value.

5. The two-stage switch apparatus according to claim 1, further comprising:

a detecting device that detects a change in electrical resistance from each of the analog portion and the digital portion, wherein the detecting device determines an activation of the analog portion before detecting an activation of the digital portion.

6. The two-stage switch apparatus according to claim 4, wherein the PCB includes a combined circuit where an analog circuit including the analog portion and a digital circuit including the digital portion are electrically combined, and the detecting device detects an activation of the analog portion and an activation of the digital portion based on a single output voltage from the combined circuit.

7. The two-stage switch apparatus according to claim 5, wherein the PCB includes a combined circuit where an analog circuit including the analog portion and a digital circuit including the digital portion are electrically combined, and the detecting device detects an activation of the analog portion and an activation of the digital portion based on a single output voltage from the combined circuit.

8. A switch apparatus, comprising:

a PCB including first and second separate electrodes;

a conductive dome disposed on the PCB and in electrical contact with the first electrode;

an insulating film disposed on a surface of the conductive dome on a side opposite to the PCB, and including third and fourth separate electrodes on an outer surface thereof above the conductive dome; and an elastically deformable conductive actuator disposed over the insulating film on a side opposite to the PCB and configured to form an analog portion when partially deformed to contact the third electrode and the fourth electrode, and to form a digital portion when fully deformed to cause the conductive dome to contact the second electrode.

9. The switch apparatus of claim 8, wherein electrical resistance between the third electrode and the fourth electrode varies inversely to respective surface areas of the third electrode and the fourth electrode contacted by the actuator.

10. The switch apparatus of claim 8, wherein the actuator includes a tapered conductive body configured to protrude toward the insulating film and to contact the third electrode and the fourth electrode when the actuator is deformed.

11. The switch apparatus of claim 8, wherein the actuator is not in contact with the insulating film in a default state.

12. The switch apparatus of claim 8, wherein the actuator has a horizontal section with an area that decreases in a direction toward the insulating film.

13. The switch apparatus of claim 8, further comprising:

a detecting device that detects a change in electrical resistance from each of the analog portion and the digital portion, wherein the detecting device determines whether the change in electrical resistance from the analog portion or a change in voltage resulting from the change in the electrical resistance exceeds a predetermined threshold value, and determines that the analog portion is activated when the change exceeds the predetermined threshold value.

14. The switch apparatus of claim 8, further comprising:

a detecting device that detects a change in electrical resistance from each of the analog portion and the digital portion, wherein the detecting device determines an activation of the analog portion before detecting an activation of the digital portion.

15. The switch apparatus of claim 13, wherein the PCB includes a combined circuit where an analog circuit including the analog portion and a digital circuit including the digital portion are electrically combined, and the detecting device detects an activation of the analog portion and an activation of the digital portion based on a single output voltage from the combined circuit.

16. The switch apparatus of claim 14, wherein the PCB includes a combined circuit where an analog circuit including the analog portion and a digital circuit including the digital portion are electrically combined, and the detecting device detects an activation of the analog portion and an activation of the digital portion based on a single output voltage from the combined circuit.

* * * * *